United States Patent [19]

Hendrickson

[11] Patent Number: 4,830,057

[45] Date of Patent: May 16, 1989

[54] SCREEN AND FLOW REGULATOR ASSEMBLY

[75] Inventor: Donald W. Hendrickson, Corona, Calif.

[73] Assignee: Hendrickson Brothers, Corona, Calif.

[21] Appl. No.: 27,440

[22] Filed: Mar. 18, 1987

[51] Int. Cl.[4] ..... F15D 1/02

[52] U.S. Cl. ..... 138/45; 239/11

[58] Field of Search ..... 137/12; 138/26, 30, 138/41, 45, 46, 40, 44; 239/11, 12, 267, 452

[56] References Cited

U.S. PATENT DOCUMENTS

| | | | |
|---|---|---|---|
| 815,806 | 3/1906 | Francis | 138/45 X |
| 2,454,929 | 11/1948 | Kempton | 138/45 |
| 2,816,572 | 12/1957 | Pratt | 138/45 X |
| 3,077,903 | 2/1963 | Honsinger | 138/45 |
| 3,109,459 | 11/1963 | Lee, II et al. | 138/40 |
| 3,724,502 | 4/1973 | Hayner et al. | 138/41 |
| 4,091,996 | 5/1978 | Nelson | 239/728 |
| 4,105,050 | 8/1978 | Hendrickson et al. | 138/45 |
| 4,161,965 | 7/1979 | Merritt | 138/45 |
| 4,248,270 | 2/1981 | Ostrowski | 138/45 |
| 4,266,576 | 5/1981 | Bradford | 138/46 |
| 4,492,339 | 1/1985 | Kreitzberg | 138/45 X |
| 4,562,960 | 1/1986 | Marty et al. | 138/45 X |
| 4,592,390 | 6/1986 | Boyd | 138/45 |
| 4,609,014 | 9/1986 | Jurjevic et al. | 138/45 |

FOREIGN PATENT DOCUMENTS

| | | | |
|---|---|---|---|
| 154109 | 7/1932 | Switzerland | 138/45 |

*Primary Examiner*—Henry J. Recla
*Assistant Examiner*—G. Barrett
*Attorney, Agent, or Firm*—Knobbe, Martens, Olson & Bear

[57] ABSTRACT

A screened fluid flow regulator assembly which is adapted to be held by a pair of fittings within the mouth of a fluid flow channel, comprising a combined screen and flow restrictor housing and a cap for sealing the restrictor in the housing.

8 Claims, 1 Drawing Sheet

Fig 1
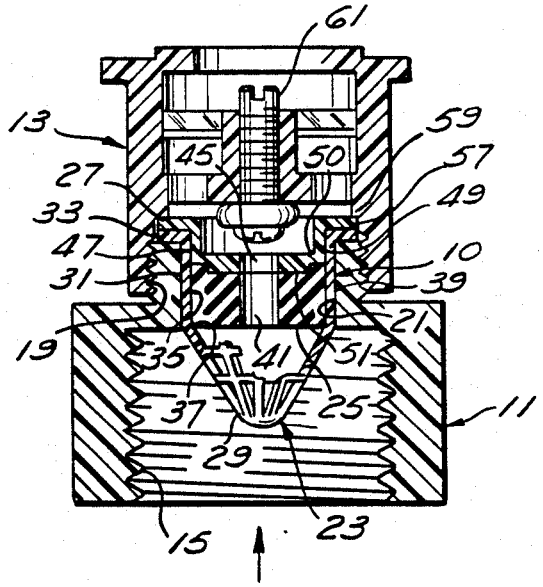
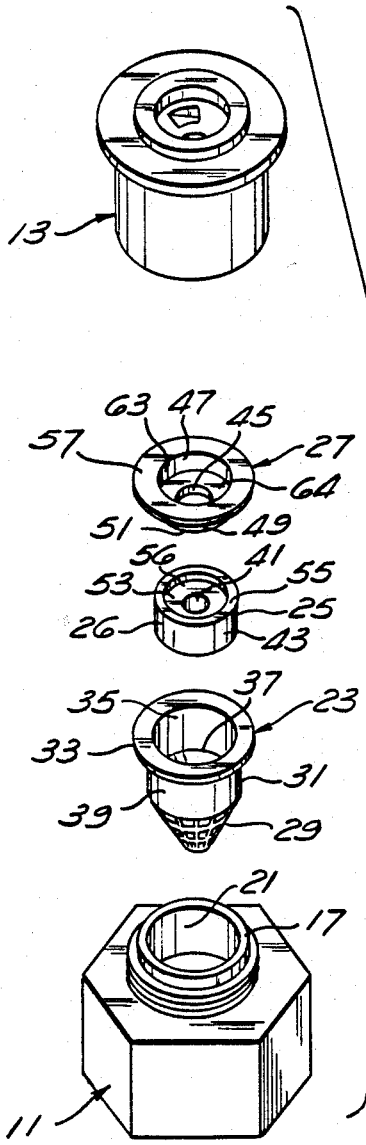
Fig. 2

SCREEN AND FLOW REGULATOR ASSEMBLY

BACKGROUND OF THE INVENTION

Numerous situations exist where fluid is piped under pressure to a number of final delivery points in which the distribution system is primarily concerned with the distribution of fluid over a given area. Typical situations for this are agricultural sprinkler irrigation systems and home garden sprinkler systems.

In many systems, maintenance of a desired level of fluid flow to certain areas within the system requires a certain minimum pressure at the system supply valve. For example, a given source pressure may be necessary to pump water to sprinklers located at the crest of a hill. Such requirements prevent the final volume rate of flow of fluid in such a system from being lowered by merely adjusting the system supply valve.

Since these systems are typically very large, however, substantial fluid savings can generally be obtained if only the required amount of fluid is discharged at each final delivery point, e.g., each sprinkler head. In order to limit the volumetric delivery rate at each final delivery point, flow restrictors such as elastomeric flow restrictors, are used to obtain a relatively constant fluid volumetric delivery rate over a relatively broad range of initial input delivery pressures. Many existing systems, however, do not include such restrictors and, therefore, the restrictors need to be added to the systems. Since the restrictors must be installed at each final delivery point, it is only practical to install such restrictors if the installation procedure can be quickly and easily performed, and if the restrictors themselves are inexpensive.

Even where the original delivery system incorporates flow restrictors, it may later be found that too large or too small a volume of fluid is being delivered to one area of the system. It is then desirable to be able to change the fluid restrictors utilized at the final delivery points in that area of the system to increase or decrease volume of fluid delivered to that area, without affecting the volume of water delivered to other areas within the system. Likewise, even in properly running systems, it is sometimes desirable to change the volume of fluid delivered throughout the system, either due to a change in the level of seasonal precipitation or a change in the delivery target, e.g., a change of crops.

Since such a restrictor is needed in the field of irrigation, it is desirable that the restrictor be able to be utilized in connection with a wide variety of sprinkler heads. Although sprinkler heads come in a range of shapes and sizes, many are provided with a screen seated within the mouth of the fluid flow channel formed by the sprinkler head fitting to which the sprinkler head is attached. To permit these screens to be used interchangeably in a variety of systems, the mouths of most sprinkler head fittings are of a standard size.

What is needed, is a fluid flow regulator which is simple, inexpensive, easy to install and replace, and is adapted to function with a wide variety of existing sprinkler systems.

SUMMARY OF THE INVENTION

A screened fluid flow regulator assembly adapted to be held by a pair of fittings within the mouth of a fluid flow channel, comprising a flow restrictor housing and a cap for capturing a flow restrictor in the housing.

The flow restrictor housing includes a screen, an interior wall partially forming a chamber into which the flow restrictor is removably insertable. The housing further includes an outwardly extending flange clampable between said pair of fittings to hold the housing at the mouth of the fluid flow channel. The assembly's housing is preferably molded as a single unit.

Advantageously, the cap further comprises an outwardly extending flange which is clampable between the pair of fittings and an interior surface which forms a clearance cavity downstream from the chamber.

Preferably, the cap also includes a projection adapted to mate with a cavity on a flow restrictor to align the restrictor in the chamber. The assembly can additionally be provided with a flow restrictor.

DESCRIPTION OF THE DRAWINGS

FIG. 1 is a cross-sectional view of the assembly of the invention in a fitting with a sprinkler head attached; and FIG. 2 is an exploded perspective view of the components of FIG. 1.

DETAILED DESCRIPTION OF THE INVENTION

FIG. 1 shows a flow regulator assembly 10 of the invention inserted for use in a fitting 11 connected to a typical lawn sprinkler head, or second fitting 13. The fitting and sprinkler head are shown for purposes of illustration only, as the assembly is readily adapted to be held within the mouth of any one of a variety of fluid flow channels. The fitting 11 may be provided with threads 15 for attachment to fluid flow pipes, or may be otherwise adapted to insert in a fluid distribution system.

The fitting 11 includes a raised cylindrical portion 17 which is threaded to engage a set of mating threads 19 of the sprinkler head 13. An interior cylindrical surface 21 within the raised cylindrical portion 17 forms the mouth of the fluid flow channel of the fitting 11. It should be understood throughout that fluid will flow from the bottom to the top in all discussions of the drawings, i.e. in the direction of the arrow.

The screened fluid flow regulator assembly includes a flow restrictor housing 23, a flow restrictor 25 and a cap 27. The flow restrictor housing 23 includes a conical screen 29, a cylindrical body 31 downstream from the screen 29, and an outwardly extending flange 33 downstream from the body 31. Preferably, the housing 23 is integrally molded as a single unit. A cylindrical interior wall 35 within the cylindrical body 31 partially forms a chamber into which the flow restrictor 25 can be inserted. The junction between the interior wall 35 and the conical screen 29 forms an annular retaining shoulder 37 which limits the axial movement of the flow restrictor 25 within the chamber.

It is also contemplated that the invention may be used in connection with a cylindrical screen. In such an instance, the cylindrical screen will either have a smaller internal diameter than that of the interior wall of the cylindrical body, so as to form an annular retaining shoulder, or tabs or other means will be used to form the shoulder in order to limit the axial movement of the restrictor in the housing.

The cylindrical body 31 has a cylindrical exterior surface 39 which conforms to the interior cylindrical surface 21 of the fitting 11, and preferably forms a fluid-tight seal therewith when the housing 23 is fully inserted within the mouth of the fluid flow channel. In operation, the housing's annular flange 33 abuts the end of the raised cylindrical portion 17 of the fitting 11 and prevents the housing 23 from slipping through the mouth of the fluid flow channel.

The flow restrictor 25 used with the assembly preferably has a generally cylindrical body with a coaxial bore 41. As shown in FIG. 1, the cylindrical flow restrictor 25 is captured within the chamber by means of the retaining shoulder 37, the interior wall 35 of the cylindrical body 31 and the cap 27. Advantageously, the interior wall 35 conforms to the outer cylindrical wall 43 of the fluid restrictor 25 so that the interior wall 35 of the housing and the exterior wall 43 of the restrictor 25 form a fluid-tight fit.

As can readily be understood from the drawings, all fluid from the fluid flow channel must pass through the screen 29 and the coaxial bore 41 of the flow restrictor 25 before it can be discharged by the sprinkler head 13. The cap 27 includes a coaxial bore 45 which communicates with the bore 41 of the fluid restrictor 25, so that all fluid passing through the coaxial bore 41 of the fluid restrictor also passes through the bore 45 of the cap. Although the bore 41 in the fluid restrictor shown in the drawings is the same size as the bore 45 in the cap, it is desirable that the cap's bore be at least as large as the bore of the fluid restrictor in order that the cap does not appreciably resist the flow of fluid after it is passed through the fluid restrictor.

The cap 27 includes a cylindrical body 47 which forms an exterior annular wall 49 having an outer diameter which conforms to the inner diameter of the interior wall 35 of the flow restrictor housing 23, so that the cap 27 fits snugly within the interior wall 35 of the housing. The height of the cap's exterior wall 49 is such that when the cap 27 is fully inserted within the interior wall 35 of the housing, the cap 27 forces the restrictor 25 against the retaining shoulder 37 of the housing 23 so that the restrictor 25 is held in proper alignment within the chamber. In order to further ensure that the restrictor 25 is properly aligned within the housing 23, a raised annular projection 51 is advantageously provided around the periphery of the cap's bore 45, which mates with a shallow cavity 53 formed by a raised peripheral projection 55 on the fluid flow restrictor.

In order to more securely hold the cap 27 against the fluid restrictor 25, an outwardly extending annular flange 57 is provided at the downstream end of the cap's cylindrical body 47. As seen in FIG. 1, when the sprinkler head 13 is firmly threaded onto the exterior threads of the fitting 11, an interior shoulder 59 within the sprinkler head 13 clamps the cap's flange 57 against the flange 33 of the restrictor, and the flange 33 of the restrictor against the raised cylindrical wall 17 of the fitting, thus capturing the restrictor in the housing 23 and holding the assembly at the mouth of the fluid flow channel.

Since many sprinkler heads incorporate a spray adjustment screw 61 as shown in FIG. 1, the cylindrical body 47 of the cap advantageously includes an interior surface 63 which forms a clearance cavity, so that the adjustment screw 61 will not block the flow of fluid from the cap bore 45.

The screened fluid flow regulator assembly, thus provided, can be installed in a wide variety of sprinkler systems by merely removing the existing screen and inserting the assembly into the mouth of the fluid flow channel. Once the assembly is installed in the system, adjustments in the volume rate of fluid flow can be made in discrete areas of the system by simply replacing the assembly with another assembly containing a flow restrictor having a larger or smaller restrictor bore. The use of the assembly of the present invention will enhance the ability of the operator to "fine tune" his fluid delivery system, while minimizing the down time of the system during system conversions. Furthermore, since the assembly design readily lends itself to injection molding techniques, the assemblies can be mass produced at a nominal per unit cost.

Although it is expected that the assembly, including a flow restrictor will be replaced as a unit, it is possible to remove the assembly, insert a new restrictor in the assembly and replace the assembly unit. Likewise, if desired, the restrictor can be removed from the assembly and the restrictor-less assembly can be inserted into the mouth of the fluid flow channel.

I claim:

1. A screened fluid flow regulator assembly adapted to be held by a pair of fittings within the mouth of a fluid flow channel, comprising:

a cylindrically shaped flow restrictor having a bore therethrough which controls the flow of fluid by permitting a controlled volumetric rate of fluid flow through said bore a housing for said flow restrictor, said housing including a cylindrically body having mounted at one end thereof a screen, said body defining an interior wall forming a chamber into which said flow restrictor is removably inserted and said body having at the opposite end thereof an outwardly extending flange integral with the other end of said body and clampable between said pair of fittings to hold said body of said housing within said mouth of said flow channel; and a cap removably inserted into said other end of said body for capturing said restrictor in said chamber, said cap including a bore for communicating with said fluid flow channel.

2. The assembly of claim 1, wherein said housing is molded as a single unit.

3. The assembly of claim 1, wherein said cap further comprises an outwardly extending flange clampable between said pair of fittings.

4. The assembly of claim 3, wherein said cap includes an interior surface which forms a clearance cavity downstream from said chamber.

5. The assembly of claim 4, wherein said cap further comprises a projection extending into said chamber for aligning said restrictor within said housing.

6. The assembly of claim 5, wherein said flow restrictor has a coaxial bore.

7. The assembly of claim 5, wherein said flow restrictor further comprises a projection adapted to mate with said cavity wherein said projection on said cap is inserted cavity to align said restrictor within said housing.

8. A flow regulator assembly system, comprising:

a first fitting having an inlet and an outlet including an internal cylindrical surface which forms the mouth of a fluid flow channel surrounded by an annular surface;

a cylindrical shaped flow restrictor having a bore therethrough which controls the flow of fluid through said system by permitting a controlled volumetric rate of fluid flow through said bore;

a housing for said flow restrictor, said housing including, a cylindrical body having mounted at one end thereof a screen, said body defining an interior wall forming a chamber into which said flow restrictor is removably inserted, wherein said body is insertable within said mouth of said fluid flow channel, said body having at the opposite end thereof an outwardly extending flange integral with the other end of said body;

a cap removably inserted into said other end of said body for capturing said restrictor in said chamber, said cap including a bore for communicating with said fluid flow channel; and a second fitting secured to said first fitting and having an annular surface disposed adjacent said annular surface on a said first fitting, said flange being disposed between said annular surfaces on said first and second fittings and clampable therebetween for securing said body of said housing within said mouth of said fluid flow channel.

* * * * *

UNITED STATES PATENT AND TRADEMARK OFFICE

CERTIFICATE OF CORRECTION

PATENT NO. : 4,830,057

DATED : May 16, 1989

INVENTOR(S) : Donald W. Hendrickson

It is certified that error appears in the above-identified patent and that said Letters Patent is hereby corrected as shown below:

Column 4, line 27, change the words "cylindrically body having" to --cylindrically shaped body having--

Column 4, lines 55-56, change the words "cap is inserted cavity to align" to --cap is inserted to align--

Signed and Sealed this

Seventh Day of January, 1992

*Attest:*

HARRY F. MANBECK, JR.

*Attesting Officer*

*Commissioner of Patents and Trademarks*